United States Patent [19]

Child

[11] Patent Number: 4,986,739

[45] Date of Patent: Jan. 22, 1991

[54] GEROTOR PUMP HAVING AXIAL FLUID TRANSFER PASSAGES THROUGH THE LOBES

[75] Inventor: Robin E. Child, Leamington Spa, United Kingdom

[73] Assignee: Concentric Pumps Limited, United Kingdom

[21] Appl. No.: 377,425

[22] Filed: Jul. 7, 1989

[51] Int. Cl.[5] ..... F04C 2/10

[52] U.S. Cl. ..... 418/15; 418/166; 418/186

[58] Field of Search ..... 418/15, 102, 166, 171, 418/167, 183, 186

[56] References Cited

U.S. PATENT DOCUMENTS 2,866,417 12/1958 Nubling ..... 418/171
2,989,951 6/1961 Charlson ..... 418/171 X
3,034,484 5/1962 Stefancin ..... 418/166 X
4,235,217 11/1980 Cox ..... 418/171
4,502,855 3/1985 Petersen et al. ..... 418/15

FOREIGN PATENT DOCUMENTS 13787 5/1970 Japan ..... 418/171

*Primary Examiner*—John J. Vrablik
*Attorney, Agent, or Firm*—Learman & McCulloch

[57] ABSTRACT

A gerotor pump set passages 32 extending parallel to the axis of rotation through the female lobed annulus, and similar passages through the male lobed rotor. These passages enable flow from the fluid inlet to pass into the working chamber such as 43 either directly at the inlet end, or after flow through those passages and through the transfer passage 43 at the opposite axial end to the inlet, without requiring a transfer passage externally of the annulus. the result is better axial filling of the working chambers, in a particularly compact design.

10 Claims, 2 Drawing Sheets

GEROTOR PUMP HAVING AXIAL FLUID TRANSFER PASSAGES THROUGH THE LOBES

This invention relates to gerotor pumps which, as well known, comprise a male and multi-lobed rotor located in and rotatable both with, and with respect to, a female annulus which is also multi-lobed but with a greater number of lobes. Each of the male lobes contact the annulus at one or more points so as to form a series of chambers between the rotor and annulus. As the rotor turns in the annulus, those chambers increase and decrease in volume in the course of each revolution relative to a fixed point. Inlet and outlet ports are diametrically related in the pump body and exposed to the chambers so that as the chambers process past the inlet port they increase in size and hence suck fluid into the chambers, and as the chambers process past the outlet port they decrease in size and so expel fluid from the chambers.

The output of such a pump depends upon a number of parameters including physical size and also speed of rotation. Size includes the length of the chambers, that is the axial length of both rotor and annulus. It is found that increasing length, or increasing speed or both, in the interests of increased output, sometimes lead to reduced pump output as compared to what is theoretically possible, and this is believed to be due to cavitation.

One conventional solution to the problem of cavitation is to provide matched pairs of inlet and outlet ports, so that each end of each chamber is exposed to the ports. This enables each chamber to be filled or emptied from both ends. However this solution is impractical in certain circumstances where space is restricted because of the need to connect the two inlets together by a linking passageway extending outside the body of the pump, and similarly with the two outlets. For example if the pump is a lubricating oil circulating pump in an I.C. engine and is located in or on the crank case wall, there may be no space available for the additional passageways which are involved in having ports at both ends. The invention aims to solve the problem.

According to the invention a gerotor pump has one or other or both of its rotor and annulus provided with transfer passages extending through its lobes and opening at one axial end only to the inlet port, and at the other or opposite axial end to a transfer cavity. The latter may be similar in area and location to the port. By these means the working fluid can flow into the chambers from the inlet port and simultaneously flow through the said transfer passages and via the cavities to enter the chambers from the opposite end to that exposed to the port but without it being necessary to provide additional passageways extending externally of the body. Better chamber filling with avoidance of cavitation but whilst maintaining compact dimensions of the pump is the result.

The invention is more particularly described with reference to the accompanying drawings wherein FIG. 1 is a diagrammatic elevation showing the rotor and annulus set of Prior art gerotor pump with the position of the inlet and outlet ports shown in broken line.

Figure 1:
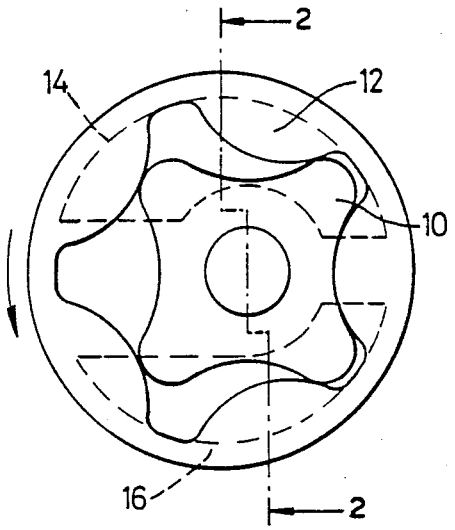
Fig. 1 (PRIOR ART)

Referring first to FIG. 1, the pump includes a casing 7 having a cap 8 at one side thereof. The gerotor set comprises a rotary driving shaft 9 fixed to male four-lobed rotor 10 assembled in a female five-lobed rotor 12. The inlet and outlet ports are shown in broken line at 14 and 16 respectively.

Figure 2:
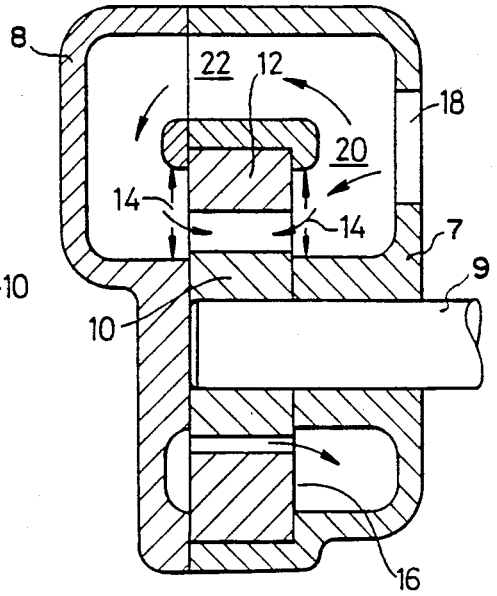
Fig. 2 (PRIOR ART)
FIG. 2 is a section taken on the line 2—2 of FIG. 1 showing the Prior art gerotor set assembled in a pump body arranged to provide inlet ports connected to both ends of the chambers.

Turning now to FIG. 2, aperture 18 is connected to the fluid supply and opens first to the manifold chamber 20 which is exposed to one axial end face of the gerotor set over the port area 14. Substantially the same port area 14 opens to the gerotor set at the opposite axial end face of the set and the two ends are connected together from the manifold area 20 via the transfer passage 22 which extends externally of the casing of the pump which provides the cylindrical cavity in which the annulus 12 is located.

The outlet port 16 may be arranged similarly to the inlet port 14, but because cavitation is not a problem on the delivery side, a single outlet port may be sufficient, as shown in the Figure.

Figure 3:
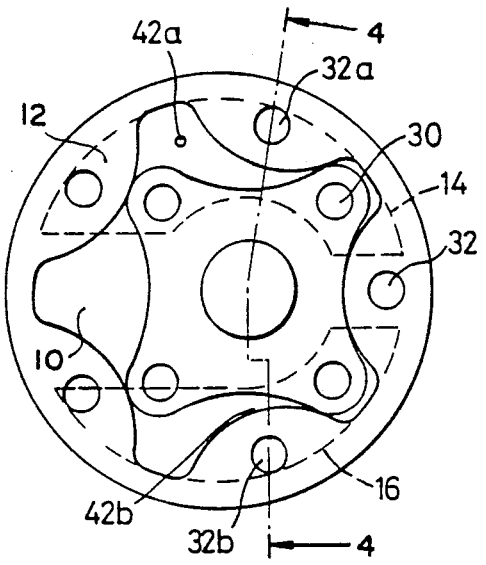
FIG. 3 shows the gerotor set similar to that in FIG. 1 but utilizing the invention in a simple form.
Figure 4:
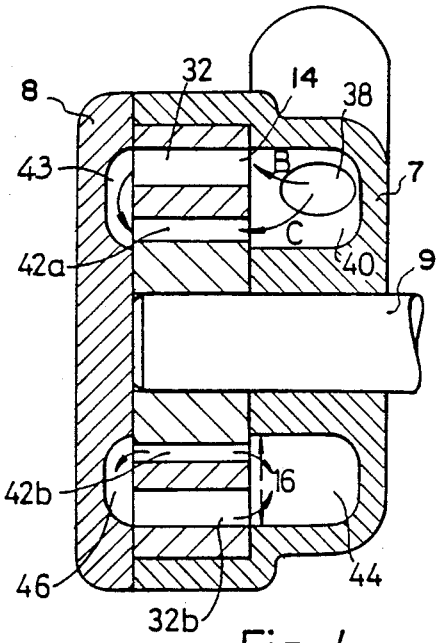
FIG. 4 is a view similar to FIG. 2 but showing the set of FIG. 3 taken on the line 4—4 assembled in a body according to the invention.

Turning now to FIGS. 3 and 4, it will be seen that the rotor is here provided with a single axially extending passage 30 in each of its lobes. The annulus has a diameter corresponding substantially to that of the chamber of the pump casing in which the annulus is accommodated and is similarly provided with transfer passages 32 extending through each of its lobes. Each of the transfer passages extends from one axial end face of the rotor or annulus to the opposite axial end face of the same.

FIG. 4 shows the aperture 38 (corresponding to the aperture 18) communicating to working chamber 40 which opens via the port 14 to the chambers. Transfer cavity 43 is, like the chamber 40, of the same area as the port 14 but at the opposite end. The cavity 43 is wholly within the cap 8. There is no connection between chamber 40 and cavity 43 except through the chambers 42*a* between the rotor and annulus and through the passages 30, 32 which are aligned with said chamber 40 and cavity 43. The outlet arrangements are the same as the inlet arrangements including chamber 44 and transfer cavity 46 which are both of the same area as the outlet port 16.

In the result, fluid flowing through the inlet aperture 38 via the chamber 40 can flow directly into the chambers such as 42*a* from the right hand end as seen in the Figures, and also through the transfer passages in the parts so as to reach the transfer cavity 43 and hence flow into the pump chambers from the left hand end as seen in FIG. 4. Likewise, in the outlet position, fluid can flow out of the working chamber 42*b* to the right in FIG. 4 directly into the chamber 44 and exhaust, or to the left in FIG. 4 via the transfer cavity 46 and through the transfer passage 32*b* to reach the chamber 44 on its way to the outlet.

In any one pump design for a specific purpose, it may be found desirable to provide either apertures 30 or apertures 32 or both sets of apertures 30, 32. Where even greater flow capacity is needful to avoid cavitation, FIG. 5 shows a possibility; and for maximum effect, FIG. 6 shows the preferred arrangements.

Figure 5:
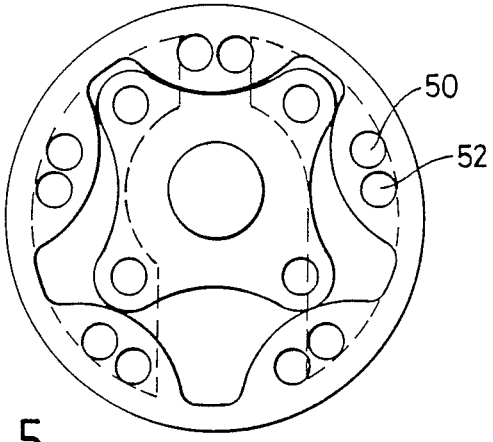
FIG. 5 shows a modification.
Figure 6:
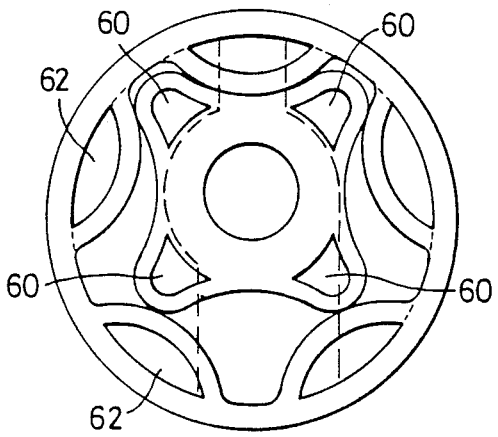
FIG. 6 shows a further modification which is the presently preferred version.

FIG. 5 shows a modification in which the annulus lobes are each provided with two transfer passages 50, 52. FIG. 6 shows a further modification in which both the rotor and annulus are provided with transfer passages of possibly the maximum size which is possible, those in the rotor being indicated by the reference numeral 60 and those in the annulus by the reference numeral 62. Passages of such complex cross-section as illustrated, which are complementary in shape to these lobes as necessary in order to make them of maximum cross-sectional area may be made for example by making the components as powder metal compacts.

I claim:

1. A gerotor pump comprising a casing having an internal chamber; an externally lobed rotor member rotatably accommodated within said chamber; an internally lobed annulus member rotatably accommodated within said casing, said rotor member being accommodated within and in mesh with said annulus member, said annulus member having one lobe more than said rotor member, each lobe of said rotor member contacting said annulus member at circumferentially spaced points to provide a series of circumferentially spaced working chambers; means for rotating said rotor member about an axis; a fluid inlet in said casing and in communication with said rotor member at one axial side thereof to admit fluid to each of said working chambers in response to rotation of said rotor member; a fluid outlet in said casing circumferentially spaced from said inlet, the spacing between said inlet and said outlet being such that each of said chamber is exposed in turn to said inlet and said outlet in response to rotation of said rotor member; an axial fluid transfer passage extending through each of the lobes of at least one of said members and being so located that each of said passages is exposed in succession to said inlet and outlet in response to rotation of said rotor member; and fluid transfer cavities in said casing at the opposite axial side of said rotor member from each of said fluid inlet and fluid outlet, said fluid transfer cavities enabling the passages that are exposed to said inlet and outlet in succession to be in communication with the working chambers at both axial sides of the members at the same time.

2. The pump according to claim 1 wherein said transfer cavity corresponds in area to that of said inlet.

3. The pump according to claim 1 wherein each of said passages is circular in cross-section.

4. The pump according to claim 1 wherein there are two of said fluid transfer passages in each lobe of said one of said members.

5. The pump according to claim 4 wherein the two fluid transfer passages are circumferentially spaced from one another.

6. The pump according to claim 1 wherein the configuration of each of said passages is complementary to that of the lobe in which said passages are located.

7. The pump according to claim 1 wherein said one of said members is said rotor member.

8. The pump according to claim 1 wherein said one of said members is said annulus member.

9. THe pump according to claim 1 wherein each of said members has at least one of said fluid transfer passages therein.

10. The pump according to claim 1 wherein said annulus member has a diameter corresponding substantially to that of said casing chamber and wherein said casing includes a cap at said opposite axial side of said rotor member, said transfer cavity being wholly within said cap.

* * * * *